US008595969B1

(12) United States Patent
Wheelis et al.

(10) Patent No.: US 8,595,969 B1
(45) Date of Patent: Dec. 3, 2013

(54) COLLECTIBLES DISPLAY CASE

(76) Inventors: Kenneth Wheelis, Surprise, AZ (US); Kelly Wheelis, Surprise, AZ (US)

( * ) Notice: Subject to any disclaimer, the term of this patent is extended or adjusted under 35 U.S.C. 154(b) by 229 days.

(21) Appl. No.: 12/946,921

(22) Filed: Nov. 16, 2010

(51) Int. Cl.
*A47G 1/06* (2006.01)

(52) U.S. Cl.
USPC ..... 40/768; 206/777; 206/778

(58) Field of Classification Search
USPC ..... 40/734, 768, 769, 606.18, 800; 206/769, 776, 777, 778
See application file for complete search history.

(56) References Cited

U.S. PATENT DOCUMENTS

| | | | | | |
|---|---|---|---|---|---|
| 3,787,992 | A | | 1/1974 | Leonhardt | |
| 5,040,671 | A | | 8/1991 | Hager | |
| 5,277,949 | A | * | 1/1994 | Green | 428/13 |
| 5,279,880 | A | * | 1/1994 | Cohart | 428/138 |
| 5,283,967 | A | | 2/1994 | Abrams | |
| 5,461,810 | A | | 10/1995 | Goserud | |
| 5,730,291 | A | * | 3/1998 | Smallwood | 206/455 |
| 5,787,625 | A | | 8/1998 | Yesbick | |
| D441,223 | S | | 5/2001 | Reeves et al. | |
| 6,315,375 | B1 | * | 11/2001 | Reeves et al. | 312/139.2 |
| 6,415,928 | B1 | | 7/2002 | Giacci | |
| 7,266,920 | B2 | * | 9/2007 | Kao | 40/800 |
| 7,464,480 | B2 | * | 12/2008 | Vetromila | 33/436 |
| 8,161,673 | B1 | * | 4/2012 | Kendall et al. | 40/800 |
| 2003/0014892 | A1 | | 1/2003 | Matsuda | |
| 2008/0187688 | A1 | * | 8/2008 | Gunther | 428/13 |

* cited by examiner

*Primary Examiner* — Kristina Junge
(74) *Attorney, Agent, or Firm* — Robert C. Montgomery; Montgomery Patent & Design

(57) ABSTRACT

A collectibles display case includes a durable frame, a front window, a rear window, and a placeholder. The front window includes a picture-frame type transparent front securely attachable to a front inside location of the frame. The back window includes a transparent back window similar to and removably located opposite the front window. The placeholder includes a corresponding pair of flat, durable frame-shaped mats with exterior perimeters of the same shape as the frame. The pair of mats each has a central rectangular opening. The placeholder is securely and removably mounted within a middle portion of the frame between the windows. The rectangular openings allow a packaged collectible having a thickness, such as a blister packed item to be "sandwiched" between the frame components and viewable housed between the windows.

2 Claims, 8 Drawing Sheets

COLLECTIBLES DISPLAY CASE

RELATED APPLICATIONS

The present invention was first described in a notarized Official Record of Invention on Sep. 17, 2009, that is on file at the offices of Montgomery Patent and Design, LLC, the entire disclosures of which are incorporated herein by reference.

FIELD OF THE INVENTION

The present invention relates generally to display cases and frames, and in particular, to a customizable display case for collectibles.

BACKGROUND OF THE INVENTION

A great many people enjoy collecting various items and objects. Such collectibles are not only limited to stamps and coins but also include other items, such as toys, die-cast metal cars, action figures, trading cards, or comic books. These items provide a sense of nostalgia for many people. To many others, these collectibles represent an investment as those that are in pristine condition and still in their retail packaging command the highest dollar. Accordingly, there is a strong desire to protect the value of such collectibles. However, this desire to protect is often offset by the need to view and enjoy the item.

Various picture frames, poster frames, shadow boxes, or similar multi-purpose cases exist for many different types of items. Typically these frames provide a structural frame and a flat transparent viewing window on only a front side. These features are well suited for flat or substantially flat items or collectibles, particularly those where only a front side of the item is ever displayed. However, many toys or other collectibles have various thicknesses and come in plastic and cardboard packaging, such as blister packaging, where frames or shadow boxes do not provide a suitable display. Additionally, many of these collectible items have images and information printed on the back side of the packaging which the owner may want to displayed as much as the front side. Those cases available to display these types of collectibles typically require the owner to use an adhesive or otherwise damage the packaging in order to position and retain the item in an upright position for display.

SUMMARY OF THE INVENTION

The inventor recognized the aforementioned inherent problems and lack in the art and observed that there is a need for a device and method by which collectible items can be displayed for enjoyment yet protected against harm and physical damage. It is an object of the present disclosure to solve these problems.

The inventor recognized these problems and has addressed this need by developing of a collectibles display case which provides a way to simply and conveniently display collectible items in a manner which also protects the item from damage, wear, or potential loss in value. The inventor has thus realized the advantages and benefits of providing a frame for enclosing a displayable collectible. The frame includes an upper horizontal segment, a pair of opposing vertical segments, a lower horizontal segment opposite the upper horizontal segment, and a frame fastening member removably connected to the lower horizontal segment. A transparent front window is mounted within the frame for viewing a front side of the collectible. A placeholder is mounted within the frame behind the front window for retaining and supporting the collectible. A transparent rear window is mounted within the frame behind the placeholder for viewing a back side of the collectible. A first groove is inset on an interior surface of the upper horizontal segment, the pair of vertical segments and the lower horizontal segment at a forward position for receiving the front window. A second groove is inset on the interior surface of the upper horizontal segment, the pair of vertical segments and the frame fastening member at an intermediate position for slidably receiving the placeholder. A third groove is inset on the interior surface of the upper horizontal segment, the pair of vertical segments and the frame fastening member at a rearward position for slidably receiving the rear window.

The placeholder includes a first mat having a customizable first mat opening which is substantially equivalent to a peripheral edge of the collectible and a second mat having a customizable second mat opening that is smaller than said first mat opening. The first mat and the second mat are connected and an offset area of the second mat between the first mat opening and the second mat opening provides a contact surface for a perimeter portion of the collectible.

The frame has a thickness such that the distance between the first groove and the second groove is sufficient to enclose the body of collectible between the front window and the placeholder. The body of the collectible protrudes through the second mat opening.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
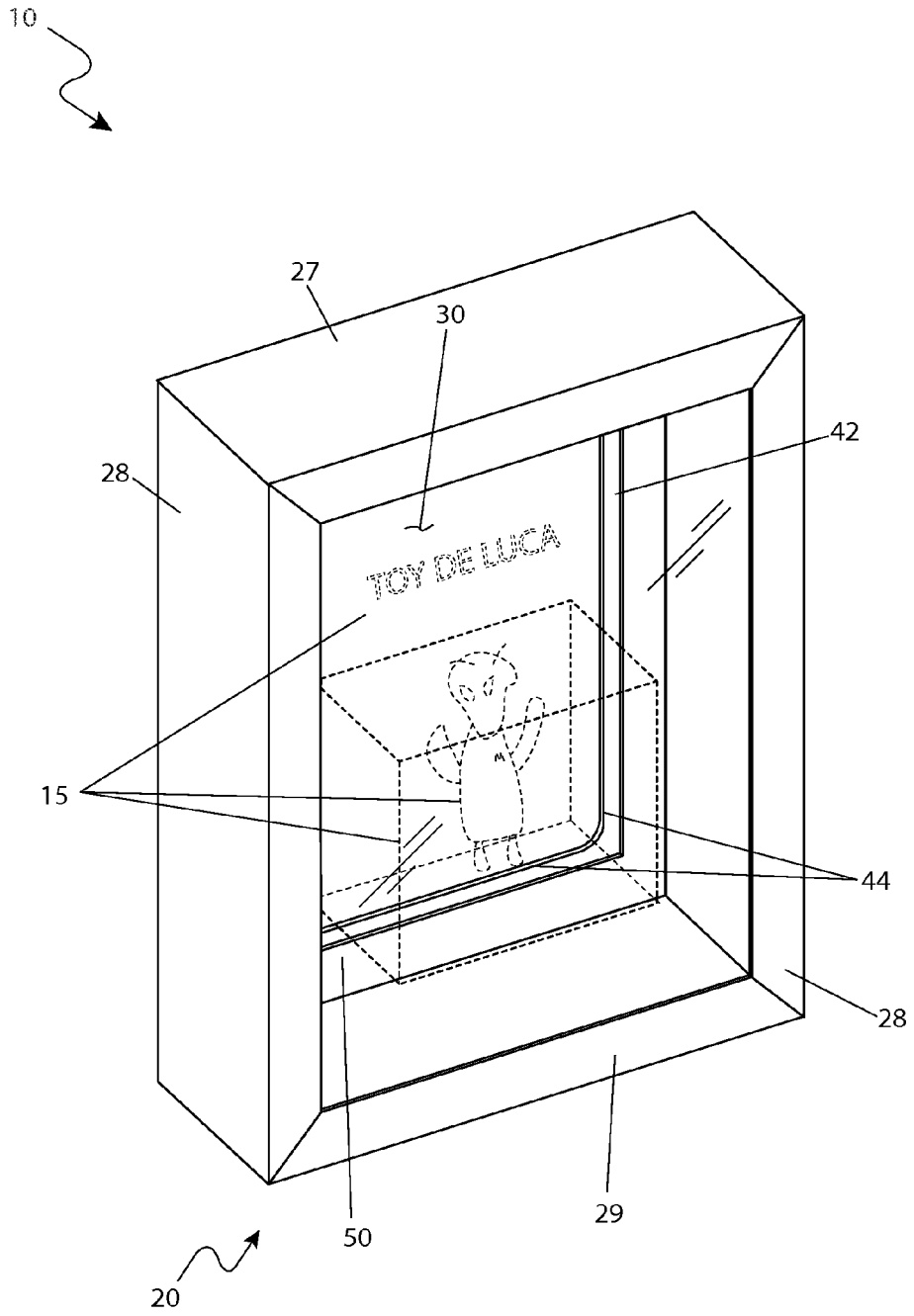
FIG. 1 is a perspective view of a collectibles display case 10, according to a preferred embodiment.

10 collectibles display case
15 collectible
20 frame
21 first groove
22 second groove
23 third groove
24 frame fastening member
25 aperture
26 fastener
27 upper horizontal segment
28 vertical segment
29 lower horizontal segment
30 front window
40 placeholder
41 first mat
42 second mat
43 first mat opening
44 second mat opening
45 offset area
50 overlay
51 overlay opening
60 rear window
70 mounting bracket

DETAILED DESCRIPTION OF THE PREFERRED EMBODIMENT

The best mode for carrying out the disclosure is presented in terms of a preferred embodiment, herein depicted within FIGS. 1 through 8. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a collectibles display case (herein described as an "apparatus") 10, which provides a structure for and method of storing and displaying packaged collectibles 15 such as, but not limited to: die-cast metal cars, action figures, playing cards, and the like in a viewable structure which enables the collectible 15 to remain in a pristine condition.

Figure 2:
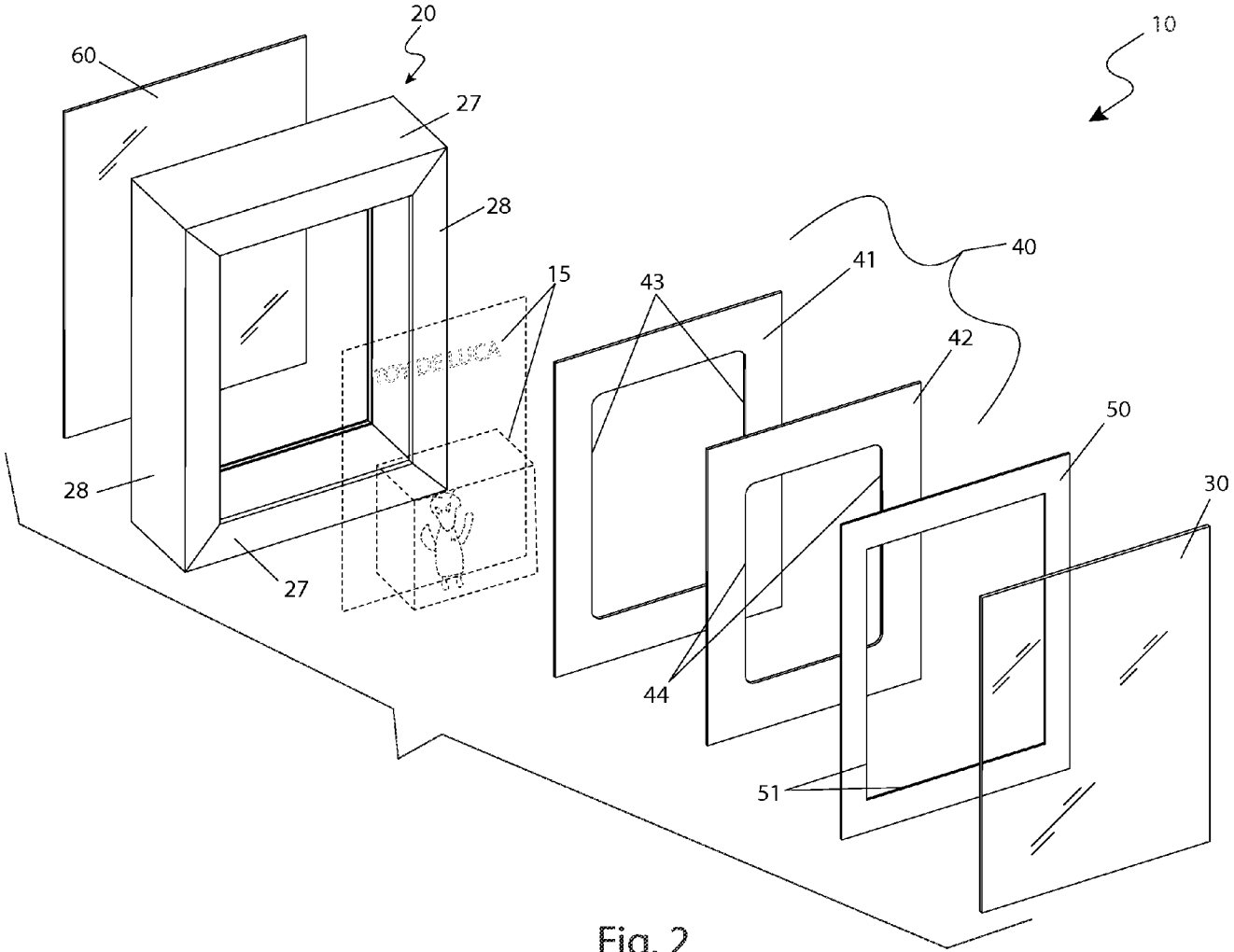
FIG. 2 is an exploded front perspective view of the collectibles display case 10, according to the preferred embodiment.

Referring now to FIG. 1, an environmental view of the apparatus 10 and FIG. 2, an exploded front perspective view of the apparatus 10, are disclosed. The apparatus 10 generally includes a frame 20, a front window 30, a first mat 41, a second mat 42, an overlay 50, and a back window 60. The apparatus 10 is customizable for a various types and styles of collectible 15 which are displayed within. The collectibles 15 are envisioned to include, but are not limited to: action figures, die cast cars, various types of trading cards, comics books, or similar collectible articles. The frame 20 provides a support structure to surround, secure, and protect the collectible 15, particularly for collectibles 15 which remain in an unopened condition within the original packaging, such as a blister pack. The frame 20 includes exterior housing having an upper horizontal segment 27 and an opposing lower horizontal segment 29 and a pair of opposing vertical segments 28 which combine to form a generally square or rectangular structure and are preferably combined as a single structure similar to a shadow box. The frame 20 is fabricated from materials such as, but not limited to, plastic, wood, or the like. The mats 41, 42, and overlay 45 are preferably made of a thin foam, cardboard, or cardstock material, yet other materials may be utilized without limiting the scope of the apparatus 10. The windows 30, 60 are preferably fabricated from transparent materials such as, but not limited to: glass, acrylic glass, or the like. All components of the apparatus 10 can be made in various dimensions to facilitate various sized collectibles 15.

Figure 3:
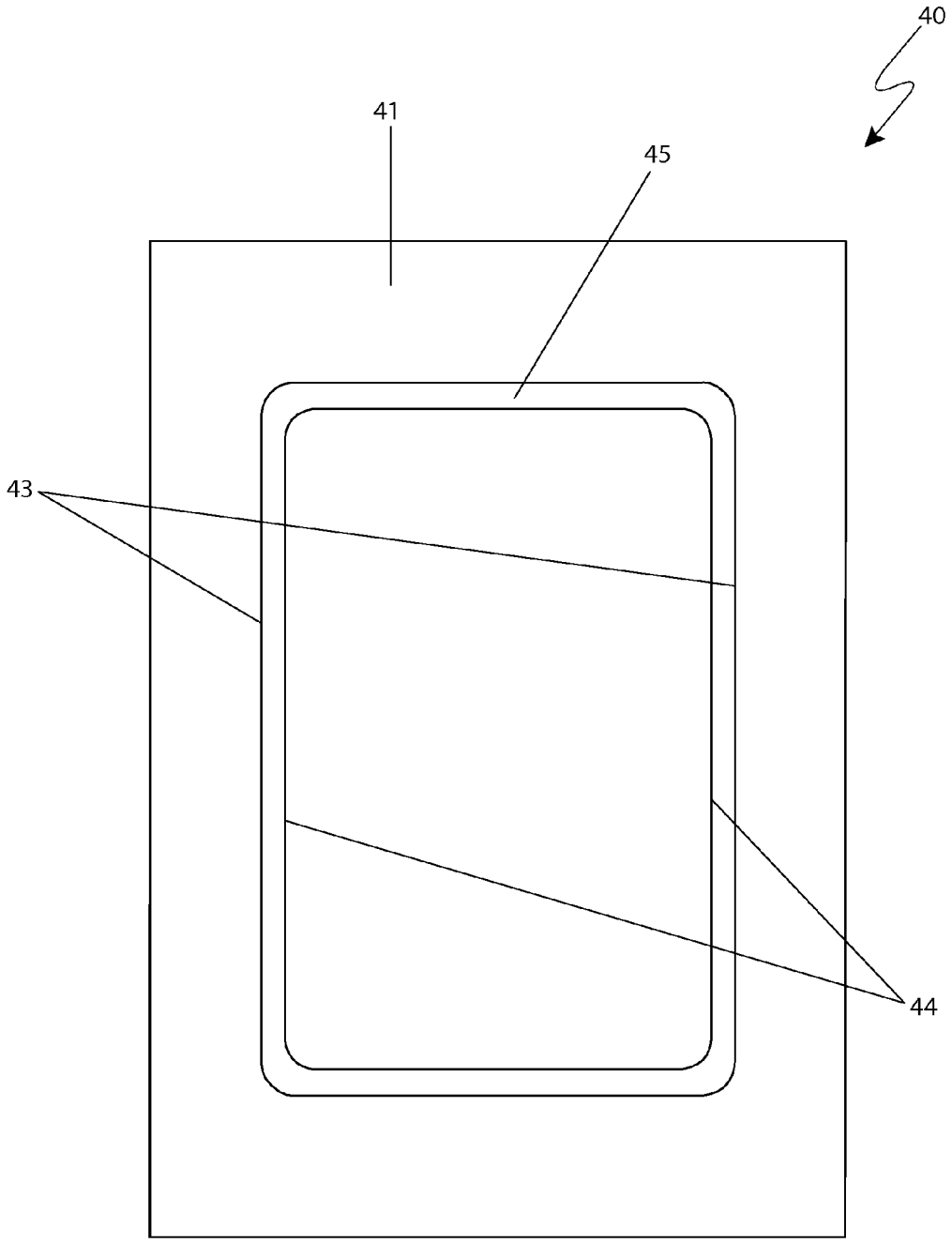
FIG. 3 a front view of a combined first mat 41 and second mat 42, according to the preferred embodiment.
Figure 4:
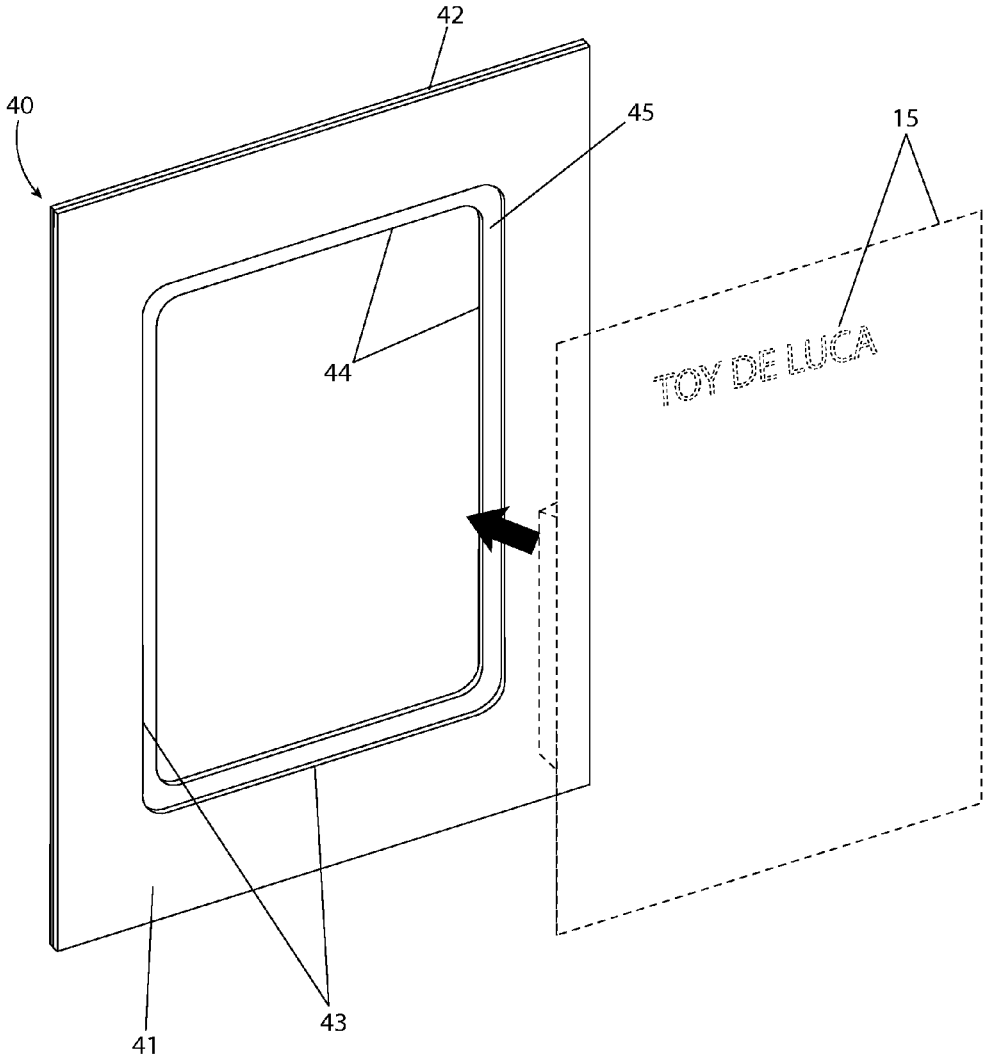
FIG. 4 is a partially exploded front perspective view of the combined first mat 41 and second mat 42 depicted with a collectible 15 being applied, according to the preferred embodiment.
Figure 5:
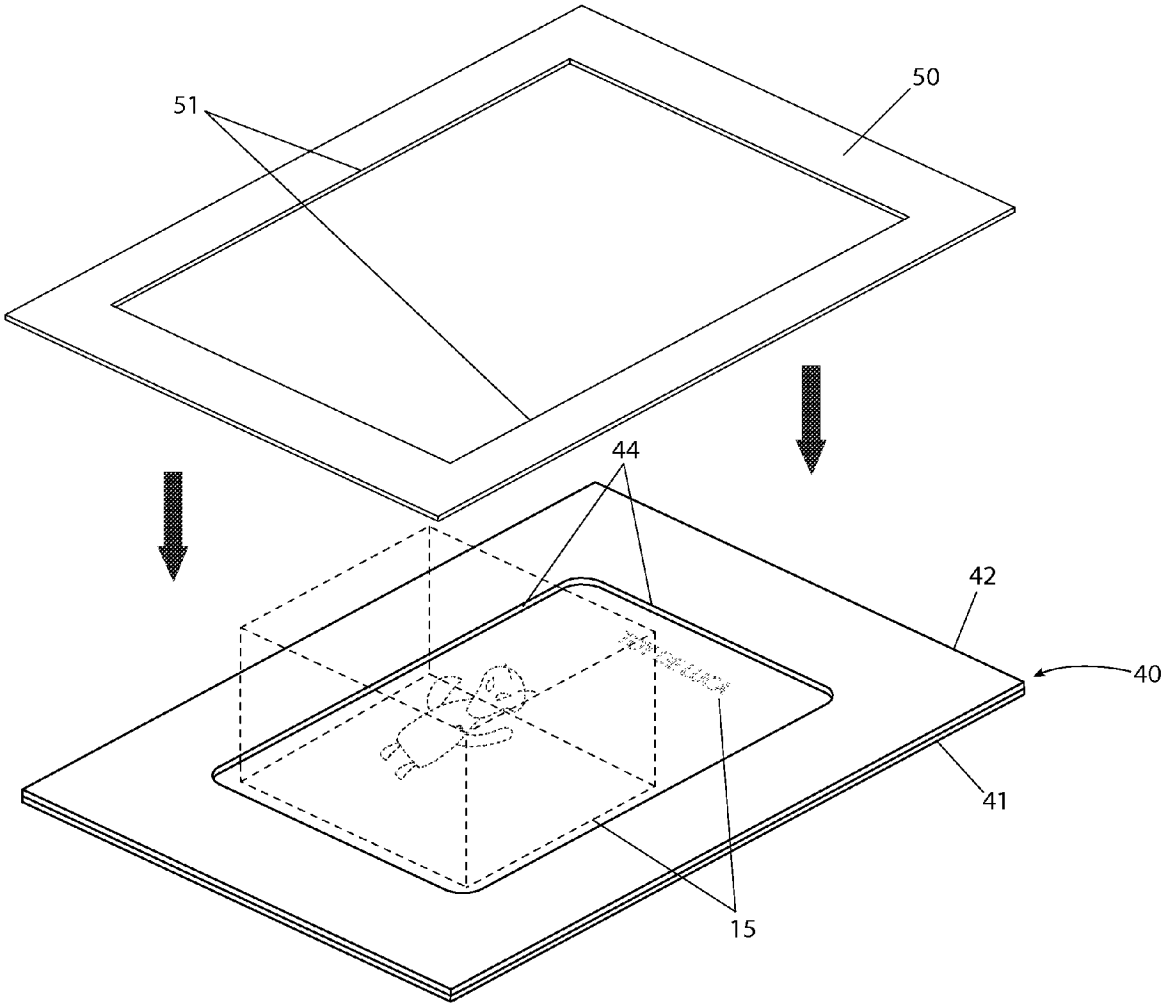
FIG. 5 is a partially exploded front perspective view of the combined first mat 41 and second mat 42 with the collectible 15 applied and an overlay 50 being applied, according to the preferred embodiment.

Referring now to FIG. 3 a front view of a combined first mat 41 and second mat 42; FIG. 4 is a partially exploded front perspective view of the combined first mat 41 and second mat 42 depicted with a collectible 15 being applied; and, FIG. 5 is a partially exploded front perspective view of the combined first mat 41 and second mat 42 with the collectible 15 applied and an overlay 50 being applied, are disclosed. The apparatus 10 includes a placeholder 40 for retaining the collectable 15 in a displayable orientation. The placeholder 40 includes a combination of the first mat 41 and the second mat 42.

The first mat 41, the second mat 42, and an overlay 50 provide vertical support and a decorative border around the collectible 15 and provide an aesthetic contrast between the collectible 15 and frame 20. Each of the mats 41, 42 are customizable in size, color, and thickness by the end user based upon the type of collectible 15 applied to the apparatus 10. The first mat 41 and second mat 42 are also customized by including a first mat opening 43 and second mat opening 44, respectively, which are can be cut to size by the user or can be provided pre-cut for particular styles of collectible packaging.

In use, the collectible 15 is centered upon the first mat 41 and the outer perimeter of the collectible 15 is outlined with writing utensil or similar marking instrument so the user can cut out the outline using a blade or scissors to create the first mat opening 43. The first opening 41 is approximately equivalent to an exterior perimeter of the packaging of the collectible 15 and provides an aperture for the collectible 15 to be inserted and allows the first mat 41 to form an exterior border around the collectible 15. The first mat 41 is then placed upon the second mat 42 and the first mat opening 43 is traced onto the second mat 42. The traced line is then offset inwardly and cut-out to form a second mat opening 44. The second mat opening 44 is preferably cut with an offset area 45 at least one-eighth (⅛) of an inch away from the border of the first mat opening 43. The offset area 45 of the second mat 42 between the first mat opening 43 and the second mat opening 44 provides a rear support surface for the backside of the packaging of the collectible 15 to rest upon. The first mat 41 is mounted to the second mat 42 after a first mat opening 43 and a second mat opening 44 are created in each respective mat 41, 42 which corresponds to the approximate width and length of the collectible 15 or the collectible packaging. The second mat 42 is preferably adhered to a rear surface of the first mat 41 such that the first mat opening 43 is aligned with the second mat opening 44 so the offset area 45 of second mat 42 provides secures the collectible 15 in a fixed vertical position. Once the first mat 41 and the second mat 42 are combined with the correct size to fit a particular size and type of collectible 15, the mats 41, 42 and frame 20 create a secure structure to retain the collectible 15 in an upright orientation for display purposes.

The overlay 50 is positioned in front of the first mat 41 and provides a color contrast and further overall aesthetic appearance to the apparatus 10. The overlay 50 provides an approximately two (2) inch border around the outside of the collectible packaging and is positioned in front of the first mat 41 to provide a clean and neat appearance to the apparatus 10 and the collectible 15. The overlay 50 includes an overlay opening 51 which allows the collectible 15 and corresponding original packaging to be completely shown through.

The collectible 15 shown as used with the apparatus 10 is depicted as a collectible action figure still within its original packaging. The apparatus 10 is designed to be used with various types of packaging including cardboard backed or clamshell type blister packs. However, it can be appreciated that various other packaged collectibles such as toys, models, trading cards, or comic books can be mounted and displayed in a similar fashion. The first mat opening 43 and second mat opening 44 will vary depending upon the type of collectible 15. Additionally, the length and thickness of the horizontal segments 27 and vertical segments 28 of the frame 20 will also vary with the type, size, and overall dimensions of the collectible 15, as will be described in further detail.

Figure 6:
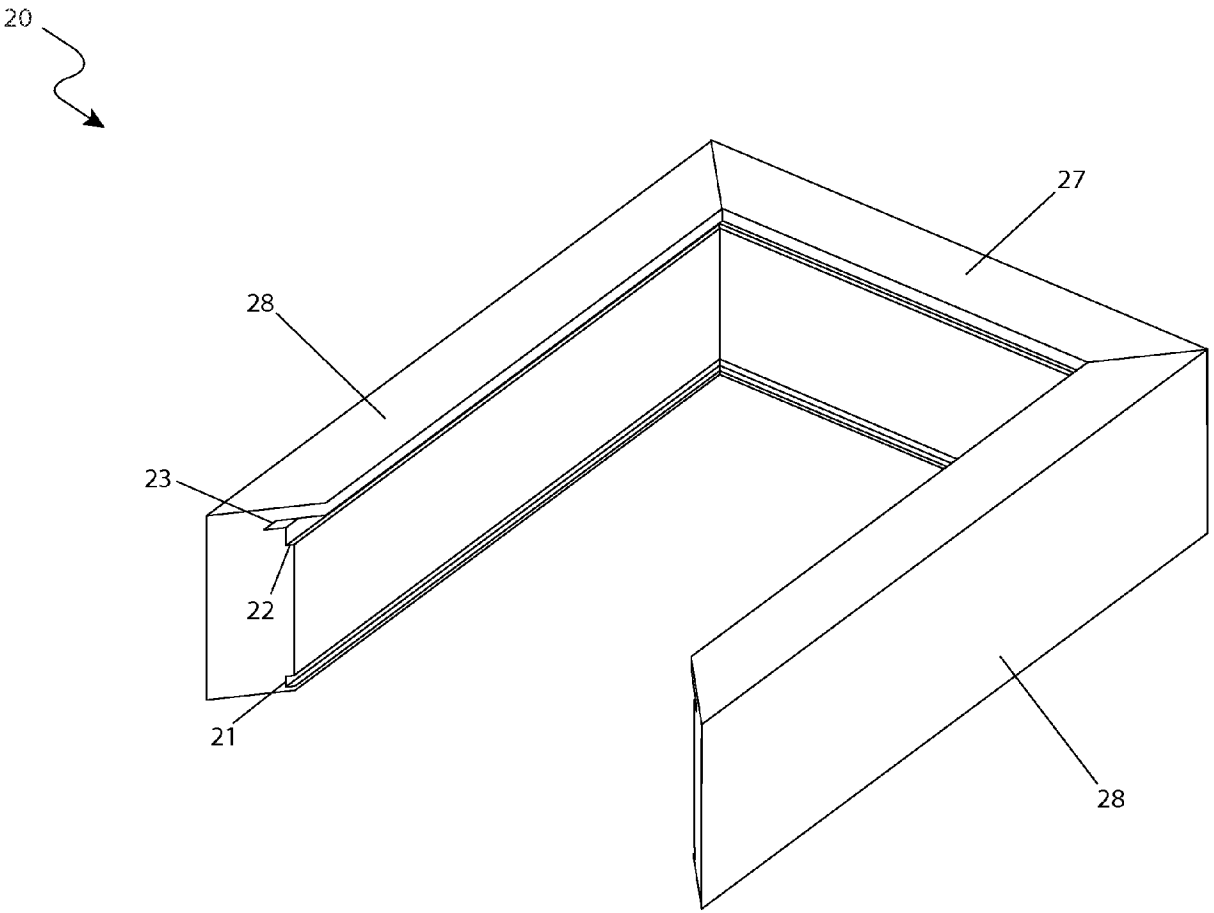
FIG. 6 is a front perspective view of a frame 20 depicting a lower horizontal segment 29 removed, according to the preferred embodiment.

Referring now to FIG. 6, a perspective view of the frame 20 depicting the lower horizontal segment 29 removed, is disclosed. The pair of horizontal segments 27 and the pair of vertical segments 28 provide the exterior structure to the frame 20. A lower horizontal segment 27 is removed for illustration purposes only and it can be appreciated that the two pairs of segments 27, 28 would be integrally molded or otherwise connected to form a solid, unitary structure. The inner surfaces of each segment 27, 28 include a first groove 21, a second groove 22, and a groove 23 which each provide a recessed area for the front window 30; the combination of the first mat 41, second mat 42, overlay 50, and collectible 15; and the rear window 60 to be inserted and secured, respectively. The first groove 21 is located on a forward end portion of each segment 27, 28 and provides a space for the placement of the front window 30. The second groove 22 is located on an intermediate portion of each segment 27, 28 and provides a space for the first mats 41, the combined second mat 42, the applied collectible 15, and the overlay 50. The third groove 23 is located on a rearward end portion, adjacent to the second groove 22 and provides a space for the rear window 60. The depth between the first groove 21 and second groove 22 may vary depending upon the size of the frame 20 and the dimensions of the collectible 15, such that the entire packaging is enclosed between the opposing front window 30 and rear window 60.

The front window 30 and the rear window 60 allow the collectible 15 to be viewed from the front or the rear when displayed within the apparatus 10. The front window 30 is positioned within the first groove 21 of the frame 20 and can be permanently affixed within the first groove 21 during fabrication processes. The front window 30 allows the front side of the collectible 15 and accompanying packaging, if any, to be completely viewed when displayed. The overlay 50 is positioned within the second groove 22. The combined first mat 41 and second mat 42 are applied within the second groove 22 behind the overlay 50. The second mat 42 faces forward and outward through the front window such that the collectible 15 is applied to and rests upon the offset area 45 provided and the exterior perimeter edge of the collectible 15 rests upon the interior perimeter edge of the first mat opening 43. The rear window 60 is inserted within the third groove 23 behind the back surface of the collectible 15 to retain the collectible 15 in contact with the offset area 45 and allows the rear surface of the collectible 15 and accompanying packaging to be viewed when displayed.

Figure 7:
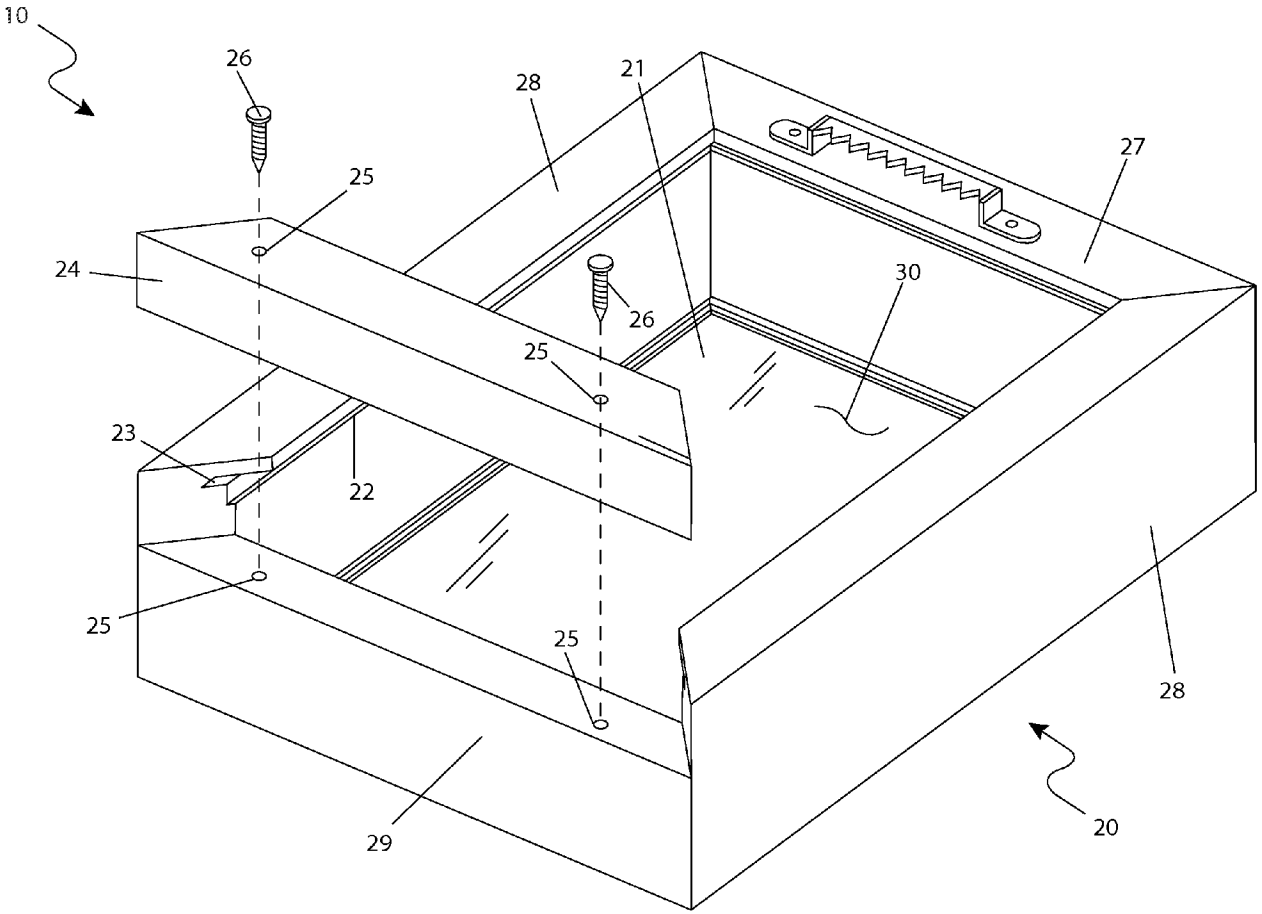
FIG. 7 is a partially exploded rear perspective view of the frame 20 depicting a frame fastening member 24 being applied, according to the preferred embodiment.

Referring now to FIG. 7, a rear perspective view of the frame depicting a frame fastening member 24 being applied, is disclosed. The lower horizontal segment 29 is substantially similar in form and materials as the upper horizontal segment 27. However, the lower horizontal segment 29 is slightly less thick and only includes the first groove 21. A removable frame fastening member 24 is connected to the lower horizontal member 29 once the overlay 50, the placeholder 40, the collectible 15 have been fit into the second groove 22 and the rear window 60 has been fit within third groove 23. Once the mats 41, 42, and overlay have been customized, each are slidingly inserted within the second groove 22. The overlay 50 is frontward, followed by the second mat 42, and followed by the first mat 41 which is most rearward. Once inserted, the collectible 15 is applied by inserting any thickness through the aligned first mat opening 43 and second mat opening 44 such that an outward perimeter portion of the collectible 15 or packaging is resting upon the offset area 45. The rear window 60 is then slidingly inserted within the third groove 23. The second groove 22 and third groove 23 are accessible due to the thinner profile of the lower horizontal segment 29. The frame fastening member 24 includes the second groove 22 and third groove 23 which align with corresponding grooves on the vertical segments 28 when connected. The frame fastening member 29 is fastened to the lower horizontal member 29 by a plurality of fasteners 26. Each opposing end of the frame fastening member 24 includes forty-five degree (45°) angle cut which aligns with the miter joint of each vertical member 28. The frame fastening member 24 also includes a pair of apertures 25 which receive the fasteners 26 which engage a pair of corresponding apertures 25 on an interior surface of the lower horizontal member 29. The fasteners 26 are preferable screws which may be removed as desired to remove the frame fastening member 24 for access to the second groove 22 and third groove 23 and thus the collectible 15.

Figure 8:
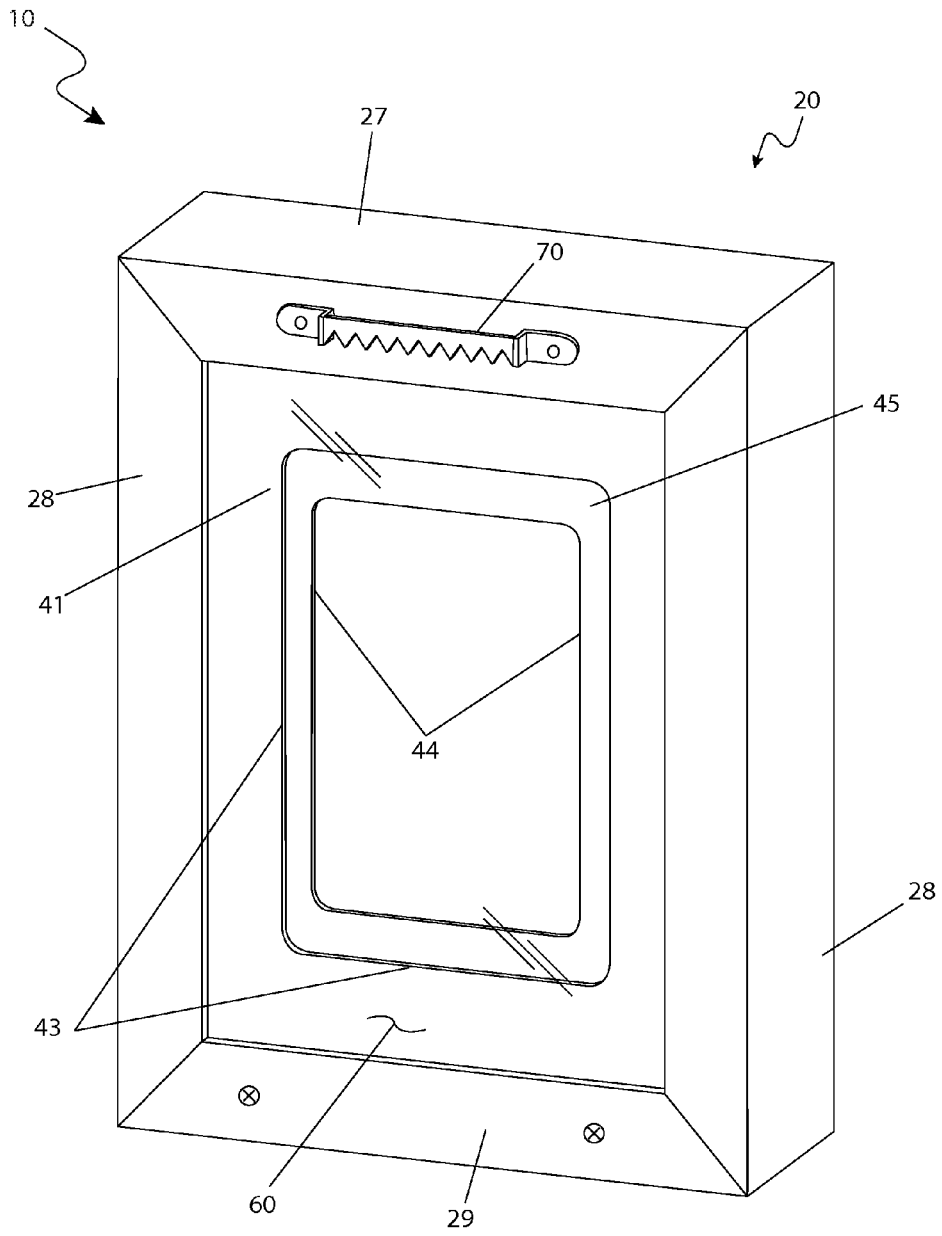
FIG. 8 is a rear perspective view of the collectibles display case 10, according to the preferred embodiment.

Referring now to FIG. 8, a rear perspective view of the apparatus 10, is disclosed. The apparatus 10 can displayed by standing the frame 20 on a desk, table, or other flat surface in an upright manner or can be hung from a wall. At least one (1) mounting bracket 70 can be attached to a backside surface of the frame 20 to provide a way to suspend the apparatus 10 from a vertical surface. The mounting bracket 70 is depicted as a saw tooth frame mounting hanger attached to the backside surface of the upper horizontal segment 27 by nails. The mounting bracket 70 engages a hanging feature such as a hook, nail, or the like which is inserting into the wall or other desired vertical surface to suspend the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present disclosure can be utilized by the common user in a simple and effortless manner with little or no training. After initial purchase or acquisition of the apparatus 10, it would be installed as indicated in FIGS. 1 through 8.

The method of installing and utilizing the mats 41, 42 and overlay 50 may be achieved by performing the following steps: acquiring the apparatus 10; positioning a collectible 15 upon the first mat 41, tracing the outer perimeter upon the first mat 41, and cutting the traced line to create a first mat opening 43; positioning the first mat 41 upon the second mat 42 and tracing the perimeter of the first mat opening 42 onto the second mat 42, offsetting the traced line, and cutting the traced line to create a second mat opening 44; adhering the second mat 42 to the first mat 41 with the openings 43, 44 aligned by applying an adhesive to the rear surface of the second mat 42 and a rear surface of the first mat 41 and mating together; positioning the overlay 50 upon the front surface of the second mat 41; and, positioning the collectible 15 into the openings 43, 44.

The method of installing and utilizing the frame 20 may be achieved by performing the following steps: positioning the frame 20 on a level surface with the front window 30 adjacent to the level surface; sliding the mats 41, 42, overlay 50, and collectible 15 into the second groove 22; inserting the rear window 60 into the third groove 23; placing the frame fastening member 24 onto the lower horizontal segment 29, aligning the apertures 25; and, securing fasteners 26 into the apertures 25.

The method of displaying the apparatus 10 may be achieved by performing the following steps: utilizing the suspending member 50 to suspend the apparatus 10 from a desired vertical surface, thereby engaging the suspending member 50 with an existing nail or hook; and, displaying collectibles 15 in a manner that is not only quick, easy and effective, but visually pleasing and protective as well.

The method of alternately displaying the apparatus 10 may be achieved by performing the following steps: positioning the apparatus 10 in an upright manner upon a desired horizontal surface; and, displaying collectibles 15 in a manner that is not only quick, easy and effective, but visually pleasing and protective as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A method of protecting and displaying a packaged collectible, said method comprising the steps of:

providing said collectible having peripheral edges and an outwardly projecting front surface;

providing a placeholder comprising a first mat having a first mat opening suitable sized to receive said peripheral edges of said packaged collectable and a second mat attached to said first mat and having a second mat opening suitably sized to receive said outwardly projecting front surface of said packaged collectible;

providing a frame to slidably mount said placeholder comprising a transparent front window mounted within said frame at a forward position spaced away from said placeholder and a transparent rear window mounted within said frame at a rearward position spaced away from said placeholder, said frame further comprising a thickness greater than a thickness of said packaged collectible;

inserting said outwardly projecting front surface of said packaged collectible through said second mat opening;

retaining said peripheral edges of said packaged collectible in a vertical position within flat peripheral sides said first mat opening such that a perimeter of said front surface of said packaged collectible contacts an offset area of said second mat;

mounting said placeholder and retained packaged collectable within said frame such that said packaged collectible is between and spaced away from said front window and said rear window.

2. The method of claim 1, wherein said first mat opening is customizable to accommodate said peripheral edges of said packages collectible and said second mat opening is customizable to accommodate said outwardly projecting front surface of said packaged collectible.

* * * * *